US005348131A

United States Patent [19]

Yamaguchi et al.

[11] Patent Number: 5,348,131

[45] Date of Patent: Sep. 20, 1994

[54] DRIVE UNIT OF CONVEYOR

[75] Inventors: Yukihiro Yamaguchi; Chuichi Saito, both of Katsuta; Tatsuhiko Takahashi, Naka; Tomomi Haraguchi, Mito, all of Japan

[73] Assignee: Hitachi, Ltd., Tokyo, Japan

[21] Appl. No.: 115,659

[22] Filed: Sep. 3, 1993

[30] Foreign Application Priority Data

Oct. 9, 1992 [JP] Japan ..... 4-242144

[51] Int. Cl.[5] ..... B66B 23/02

[52] U.S. Cl. ..... 198/330; 198/321

[58] Field of Search ..... 198/321, 329, 330, 816, 198/860.3

[56] References Cited

U.S. PATENT DOCUMENTS 2,949,178 8/1960 Fabula ..... 198/330 X

FOREIGN PATENT DOCUMENTS 0039272 3/1977 Japan ..... 198/330

2095196 9/1982 United Kingdom ..... 198/330

*Primary Examiner*—James R. Bidwell

*Attorney, Agent, or Firm*—Antonelli, Terry, Stout & Kraus

[57] ABSTRACT

A drive unit of a conveyer having a frame structure extending from one place to another place, a step chain mounting thereon a plurality of step treads and arranged inside the frame structure and a step chain sprocket for driving the step chain, which drive unit comprises a reduction gear and a motor for driving and controlling the step chain sprocket through the reduction gear, and is characterized in that the whole upper side of the reduction gear is of an opening covered with a base plate, and that the base plate is formed by unifying a top cover for the opening of the reduction gear and a motor base through reinforcing ribs disposed therebetween so as to be parallel to each other, the motor being mounted on the base plate so as to be horizontally movable in a direction perpendicular to an output shaft of the motor.

10 Claims, 3 Drawing Sheets

DRIVE UNIT OF CONVEYOR

BACKGROUND OF THE INVENTION

The present invention relates to a drive unit of a conveyer installed in a horizontal path or an inclined path; and, more particularly, the invention relates to a drive unit of a conveyer capable of saving space and providing improving assembling and inspection efficiencies.

A conventional drive unit for conveyer is disclosed in Japanese Utility Model Publication (JU-B) No. 63-48621 (1988) (Laid Open (JU-A) No. 60-183784 (1985)), for example. This conventional drive unit has a reduction gear mechanism and a motor which is mounted directly on an inclined upper surface of the reduction gear mechanism so as to be slidable along the inclined upper surface. This drive unit is advantageous in that the space for the drive unit in the machine room of the conveyer is minimized by stacking the reduction gear mechanism and the motor, and a margin for manufacturing accuracy is provided by adopting a drive arrangement such as a chain and sprocket or belt and pulley, for transmitting drive power between the motor and the reduction gear.

Another example of a conventional drive unit for a conveyer also is disclosed in the above-referenced Japanese Utility Model Publication. In this second example, a motor is mounted on the upper side of the reduction gear mechanism by stud bolts fixed to the reduction gear housing. The stud bolts used for fixing the motor also are used for adjusting the height of the motor from the upper surface of the reduction gear mechanism, thereby to adjust the tension of a chain provided for transmitting rotation of the motor to the reduction gear. This conventional drive unit also has the same advantage of the first mentioned drive unit.

The above-mentioned two conventional drive units, however, have a disadvantage in that the tooth flank inspection of the reduction gear may be performed only partially because the opening for an inspection port in the reduction gear housing cannot be made wider since the motor is mounted on the upper side thereof. Further, the drive units each have a disadvantage of an increased manufacturing cost since the structure needs to add the motor-mounting part to the inspection port on the top of the reduction gear housing. Furthermore, the first-mentioned conventional drive unit, which has the motor mounted on the inclined upper surface of the reduction gear housing, has a disadvantage in that when the motor is lifted up and mounted on the reduction gear mechanism, the work cannot be performed easily in that the motor-leg plane is parallel to the motor-mounting part on the inclined top surface of the reduction gear housing, that is, providing unstable balancing condition for the motor due to the inclination of the top surface of the reduction gear housing.

Further, another example of a conventional drive unit for a conveyer is disclosed in Japanese Patent Application Laid Open No. 62-280186 (1987). The drive unit is provided with a table whose sole purpose is to support the drive motor. The table comprises a pair of side plates and an upper plate fixed to the pair of side plates. A reduction gear is disposed under the upper plate of the table so as to be sandwiched by the pair of side plates, and a motor is mounted on the upper plate of the table so as to be movable thereon.

This conventional drive unit also has the same advantage as the above-mentioned conventional drive units; however, the drive unit has a disadvantage in that the tooth flank inspection of the reduction gear may be performed only partially since the opening for an inspection port cannot be made wider, even though the assembling work may be performed under a stable balancing condition for the motor. Further, the drive unit has a disadvantage of increased manufacturing cost since the reduction gear housing must be enlarged in size when the opening for the inspection port is widened, and the table for supporting the motor also is needed.

SUMMARY OF THE INVENTION

An object of the present invention is to provide a drive unit of a conveyer which is simple in structure and stable in power transmission and which facilitates the mounting of a motor under a balanced and stable condition of the motor thereby to improve the ease of assembling.

A further object of the present invention is to provide a drive unit of the type described in which the reduction gear housing is provided with a wide opening on the upper side thereof, which also serves as an inspection port, thereby to improve ease of maintenance of the drive unit.

The present invention resides in a drive unit of a conveyer having a frame structure extending from one place to another place, a step chain having mounted thereon a plurality of step treads and being arranged inside the frame structure, and a step chain sprocket for driving the step chain. The drive unit comprises a reduction gear mechanism and a motor for driving and controlling the step chain sprocket through the reduction gear mechanism, and is characterized in that the whole upper side of the reduction gear housing is provided with an opening covered with a base plate, and that the base plate is formed by unifying a top cover for the opening for the reduction gear housing and a motor base through reinforcing ribs disposed therebetween so as to be parallel to each other, the motor being mounted on the base plate so as to be horizontally movable in a direction perpendicular to an output shaft of the motor.

As one aspect of the present invention, the base plate has hooks provided at both ends thereof in a perpendicular direction to the output shaft of the motor for lifting and suspending the motor or the entire drive unit.

As another aspect of the present invention, some of the hooks at one end of the base plate serve as lugs securing thereto adjusting screws for horizontal positioning of the motor.

The drive unit of the conveyor according to the present invention provides an improved assembling efficiency, since the upper side of the reduction gear housing which serves for mounting the motor, is horizontal, and the work to install the motor can, therefore, be performed by lifting and suspending the motor in a stable balancing condition. Further, the ease of inspection can be improved since the whole of the upper side of the reduction gear is an open structure serving as an inspection port from which the whole inside of the reduction gear mechanism can be seen.

Furthermore, the motor can be settled on the reduction gear housing without any complex change in the drive unit since the base plate, having a combined structure of the top cover of the reduction gear and the motor base, does not have the conventional inspection port formed in a part of the upper side thereof, which is equivalent to changing a conventional cover for the inspection port to the base plate.

In addition to the above, for inspection of the inside of the reduction gear mechanism, the motor together with the base plate can be lifted and suspended while maintaining its balance by using the hooks provided on the base plate. Finally, horizontal positioning of the motor can be done with ease and accuracy since there are provided hooks serving also as lugs securing the adjusting screws for horizontal positioning of the motor.

DETAILED DESCRIPTION OF A PREFERRED EMBODIMENT OF THE INVENTION

An embodiment of a drive unit of a conveyer according to the present invention will be described hereinunder with reference to the drawings.

Figure 1:
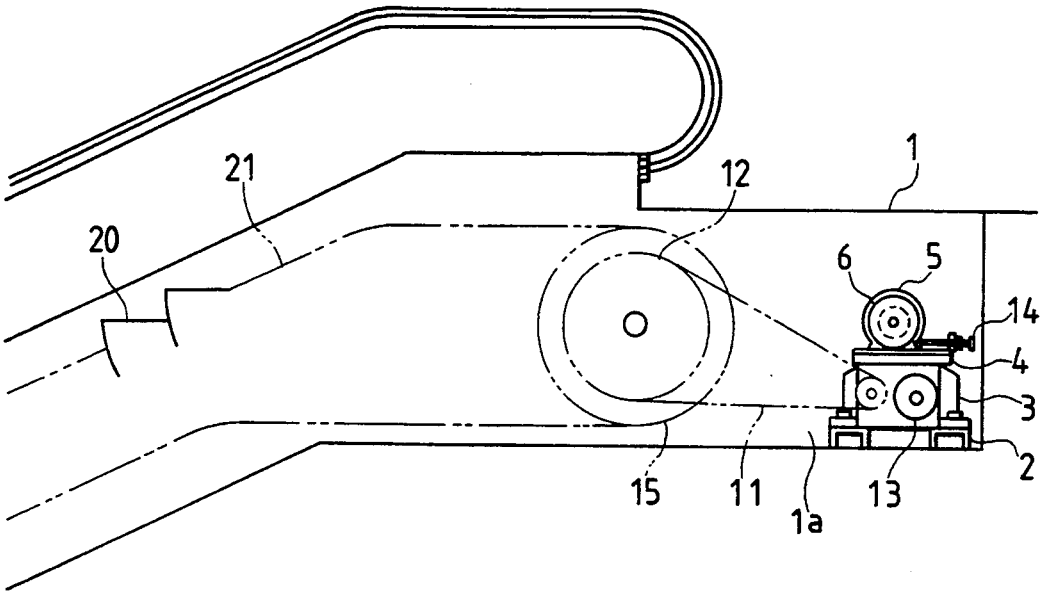
FIG. 1 is a side view of a construction of a passenger conveyer according to the present invention.

FIG. 1 shows a passenger conveyer employing an embodiment of a drive unit in accordance with the present invention. The passenger conveyer comprises a frame structure 1 extending from one place to another place, a plurality of step treads 20, an endless step chain 21 installed inside the frame structure 1 and having the plurality of step treads 20 mounted thereon, a step chain sprocket 15 rotatably mounted on the frame structure 1 and engaged with the step chain 21 to drive it, and a drive unit disposed in a machine room 1*a* at one end of the frame structure 1.

Figure 2:
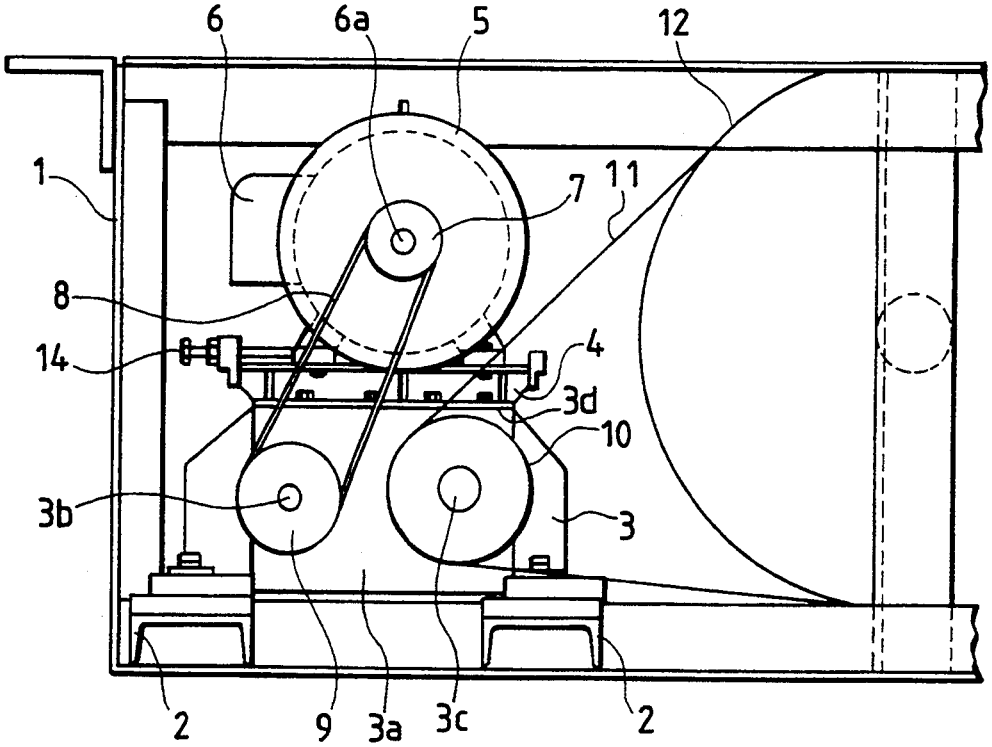
FIG. 2 is a side view of a construction of an embodiment of a drive unit according to the present invention.
Figure 3:
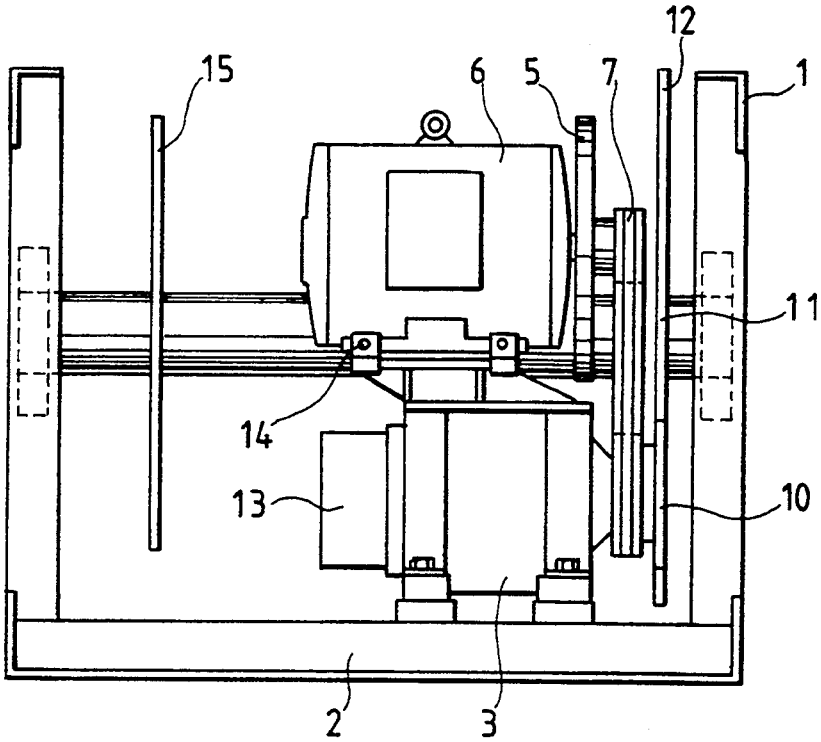
FIG. 3 is a front view of the construction shown in Fig. 2.

The drive unit of the passenger conveyer, as illustrated more clearly in FIGS. 2 and 3, comprises a reduction gear mechanism 3 fixed to the frame structure 1 through a pair of machine supports 2, a base plate 4 mounted on the upper side of the reduction gear mechanism 3, and a motor 6 mounted on the base plate 4. The reduction gear mechanism 3 comprises a casing 3*a* and a gear train (not shown) accommodated in the casing 3*a*. A pinion shaft 3*b* and a gear shaft 3*c* of the gear train each are rotatably supported by the casing 3*a*. The pinion shaft 3*b* has a driven pulley 9 fixed thereto, and the gear shaft 3*c* has a driving sprocket 10 fixed thereto. The driving sprocket 10 is for driving the step chain sprocket 15 through a driving chain 11 engaged with the driving sprocket 10 and a chain sprocket 12 fixed to a shaft on which the step chain 15 is secured. The reduction gear mechanism 3 has a brake 13 on the opposite side to the side on which the driven pulley is provided.

The motor 6 is mounted on the base plate 4 so that the motor 6 can slide and be adjusted in its position on the surface of the base plate 4 in a direction perpendicular to the output shaft 6*a* of the motor 6 by an adjusting screw 14. The output shaft 6*a* of the motor 6 has a flywheel 5 and a driving pulley 7 secured thereon. The driving pulley 7 is operatively connected to the driven pulley 9 of the reduction gear mechanism 3 through a V-belt 8 wound thereon.

When the motor 6 is operated according to an instruction, the driving pulley 7 and the flywheel 5 are rotated by the motor 6. The rotation is transmitted to the reduction gear mechanism 3 through the V-belt 8, and the gear shaft 3*c* is driven at a reduced speed, wherein the rotation is reduced. The reduced rotation is outputted to the driving sprocket 10 which drives the step chain sprocket 15 through the drive chain 11 and the chain sprocket 12. The step chain 21 is moved along the frame structure 1 by the step chain sprocket 15, whereby the step treads 20 are moved along the conveying path to convey passengers from one place to another place.

The upper side or surface 3*d* of the reduction gear mechanism 3 is parallel to the support surface thereof, which is horizontal. The whole of the upper side 3*d* of the reduction gear mechanism 3, that is the whole upper portion 3*d* of the casing 3*a* is formed as an opening, and the opening is covered with the base plate 4 formed by uniting a motor base and a top cover for the reduction gear mechanism 3. The motor 3 is mounted on the base plate 4 so that the motor is horizontal.

Figure 4:
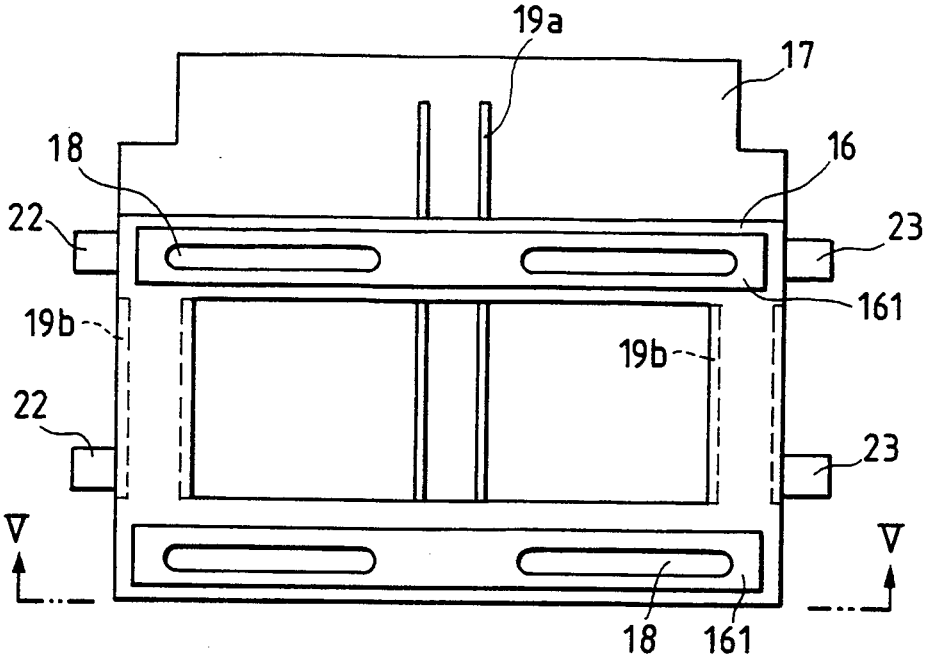
FIG. 4 is a plan view of a base plate employed in the drive unit.
Figure 5:
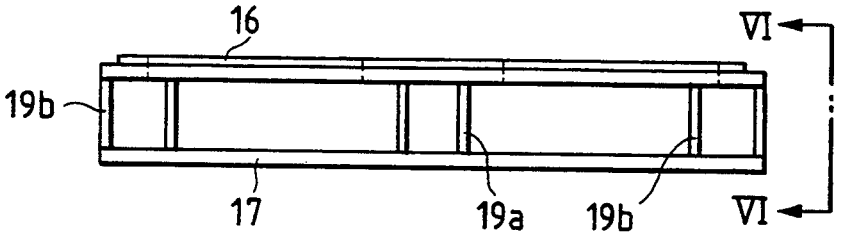
FIG. 5 is a front sectional view of the base plate viewed along the line V—V in FIG. 4.
Figure 6:
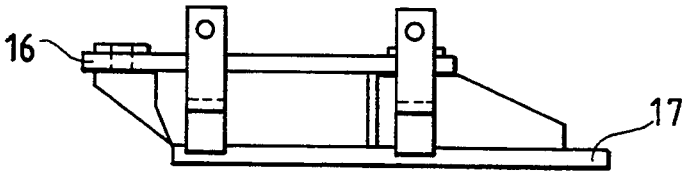
FIG. 6 is a side sectional view of the base plate viewed along the line Vi—Vi in FIG. 5.

The base plate 4 is constructed as shown in FIGS. 4 to 6. Namely, the top cover 17 for the reduction gear mechanism 3 and the motor base 16 for fixing the motor 6 are joined fixedly to each other through reinforcing ribs 19*a*, 19*b* which are disposed therebetween so that the top cover 17 and the motor base 16 are parallel to each other. The motor base 16, as shown in FIG. 4, has a rectangular opening at its central portion to reduce its weight, and a pair of reinforcing plates 161 are joined thereto. The motor base 16 has two pairs of long holes which are perforated through the motor base 16 and the reinforcing plate 161 and extend in a direction perpendicular to the output shaft 6*a* of the motor 6. The long holes 18 are used for mounting the motor 6 on the base plate 4 by means of bolts, for example.

The motor base 16 and the top cover 17 are separated vertically from each other by the two pairs of reinforcing ribs 19*b* disposed at both ends thereof in the perpendicular direction to the motor output shaft 6*a* and the pair of reinforcing ribs 19*a* disposed in a central portion between the two pairs of the reinforcing ribs 19*b*. Both ends of the motor base 16 are separated from the corresponding ends of the top cover 17 in the horizontal direction, as seen in FIG. 6, so that one end of the motor base 16 is horizontally shifted with respect to the top cover to provide a space for the flywheel 5 above the top cover 17 when the motor 6 and the flywheel 5 are assembled, as shown in FIG. 3. The reinforcing ribs 19*a*, 19*b* keep a certain space between the top cover 17 and the motor base 16, damp the vibration generated by the motor 6 and increase the total strength of the base plate 4.

The base plate 4, thus constructed, is further provided with hooks 22 for suspending the motor 6 or the drive unit and hooks 23 also serving as lugs which are perpendicular to the longitudinal direction of the long holes 18. Adjusting screws 14 are mounted on the hooks 23 and engage the motor 6 to position the motor 6 in the direction of the long holes 18, as seen in FIGS. 2 and 3.

According to the embodiment of the present invention, the motor 6 is movable in the direction perpendicular to the output shaft 6*a* of the motor 6, thereby to adjust the tightness of the V-belt 8. Further, for inspection of the inside of the reduction gear mechanism 3, the motor 6 can be elevated and suspended together with the base plate 4 while keeping balance by using the hooks 22 and the hooks 23, also serving as lugs, to lift the entire motor and base plate assembly, and then the top of the reduction gear mechanism 3 can be opened and used as an opening for inspection of the tooth flank of the gears, etc., which improves the ease of inspection.

Furthermore, according to the embodiment of the present invention, when the motor 6 is moved on the base plate 4 using the adjusting screws 14, the gap between the motor 6 or the flywheel 5 and the adjacent part of the frame structure 1 can be kept constant since the motor 6 mounted on the base plate 4 above the reduction gear mechanism 3 is movable in the direction perpendicular to the output shaft 6*a* of the motor 6, which leads to a simplified arrangement with the peripheral units.

Still further, when the motor 6 is mounted inside the frame structure 1, the motor 6 can be installed with extreme efficiency and safety since the leg portions of the motor 6 are in contact with the base plate 4 so as to be parallel to each other, since the base plate 4 is horizontal.

The embodiment of the present invention is described for a case where the present invention is applied to a passenger conveyer installed in an inclined path, that is, an escalator. The present invention, however, is applicable to a conveyer installed in a horizontal path, such as a moving walk of the like, and also to a freight conveyer, and attains the same effects as the described embodiment.

What is claimed is:

1. A drive unit of a conveyor having a frame structure extending from one place to another place, a step chain having a plurality of step treads mounted thereon and arranged in said frame structure and a step chain sprocket for driving said step chain, said drive unit comprising a reduction gear mechanism and a motor for driving and controlling said step chain sprocket through said reduction gear mechanism, an upper side of said reduction gear being formed as an opening covered with a base plate, said base plate being formed by unifying a top cover for said opening of said reduction gear mechanism and a motor base through reinforcing ribs disposed therebetween in parallel relation to each other.

2. A drive unit according to claim 1, wherein said motor is mounted on said base plate so as to be horizontally moveable in a direction perpendicular to an output shaft of said motor.

3. A drive unit according to claim 2, wherein said motor base of said base plate has elongated holes extending in a direction perpendicular to the output shaft of said motor for securing said motor to said base plate.

4. A drive unit according to claim 2, wherein said base plate has hooks provided at two opposite ends thereof in a perpendicular direction to the output shaft of said motor for lifting and suspending at least one of said motor or said drive unit.

5. A drive unit according to claim 4, wherein said hooks provided at one end of said base plate serve as lugs securing thereto adjusting screws for adjusting a horizontal position of said motor in a direction perpendicular to the output shaft of the motor.

6. A drive unit according to claim 1, wherein one end of said motor base is shifted horizontally with respect to said top cover so as to provide a space for a flywheel mounted on an output shaft of said motor.

7. A drive unit according to claim 3, wherein said motor base has a central opening at a central portion thereof and peripheral portions reinforced by a pair of reinforcing plates, said elongated holes being formed at the positions of said reinforcing plates.

8. A drive unit according to claim 1, wherein said reduction gear mechanism includes a casing supporting rotatably a pinion shaft and a gear shaft, said casing having an open upper side covered with said base plate.

9. A drive unit according to claim 1, wherein two pairs of said reinforcing ribs are provided at respective ends of said base plate so as to extend in a parallel direction to an output shaft of said motor and a further pair of said reinforcing ribs are arranged between said two pairs of said reinforcing ribs.

10. A drive unit according to claim 1, wherein said base plate has hooks provided at two opposite ends thereof in a perpendicular direction to an output shaft of said motor for lifting and suspending one of said motor or said drive unit.

* * * * *